US008487175B2

(12) United States Patent
Arimoto et al.

(10) Patent No.: US 8,487,175 B2
(45) Date of Patent: Jul. 16, 2013

(54) MUSIC ANALYSIS APPARATUS

(75) Inventors: Keita Arimoto, Barcelona (ES); Sebastian Streich, Rijswijk (NL); Bee Suan Ong, Rijswijk (NL)

(73) Assignee: Yamaha Corporation, Hamamatsu-shi (JP)

( * ) Notice: Subject to any disclaimer, the term of this patent is extended or adjusted under 35 U.S.C. 154(b) by 100 days.

(21) Appl. No.: 13/081,337

(22) Filed: Apr. 6, 2011

(65) Prior Publication Data

US 2011/0271819 A1 Nov. 10, 2011

(30) Foreign Application Priority Data

Apr. 7, 2010 (JP) ..... 2010-088353

(51) Int. Cl.
*G10H 1/40* (2006.01)
*G10H 7/00* (2006.01)

(52) U.S. Cl.
USPC ..... 84/611; 84/635

(58) Field of Classification Search
USPC ..... 84/611, 635
See application file for complete search history.

(56) References Cited

U.S. PATENT DOCUMENTS

2002/0005110 A1* 1/2002 Pachet et al. ..... 84/635
2003/0205124 A1* 11/2003 Foote et al. ..... 84/608
2004/0005924 A1* 1/2004 Watabe et al. ..... 463/36
2008/0060505 A1 3/2008 Chang et al.
2008/0072741 A1 3/2008 Ellis
2008/0115656 A1 5/2008 Sumita
2008/0236371 A1 10/2008 Eronen
2008/0300702 A1* 12/2008 Gomez et al. ..... 700/94

FOREIGN PATENT DOCUMENTS

EP 2 093 753 A1 8/2009

OTHER PUBLICATIONS

Bello, J.P. (Oct. 2009). "Grouping Recorded Music by Structural Similarity," *International Society on Music Information Retrieval Conference*, Kobe, JP, located at http://www.nyu.edu/classes/bello/Colloquy_files/ISMIR09.pdf, last visited on Jul. 28, 2011, six pages.
European Search Report mailed Aug. 11, 2011, for EP Application No. 11161256.0, eight pages.
Paulus, J. et al. (2002). "Measuring the Similarity of Rhythmic Patterns," IRCAM, seven pages.
Tsunoo, E. et al. (Mar. 2008). "Rhythmic Features Extraction from Music Acoustic Signals using Harmonic/Non-Harmonic Sound Separation," 2008 Spring Meeting of the Acoustic Society of Japan, pp. 905-906, with English Translation, seven pages.
U.S. Appl. No. 13/081,408, filed Apr. 6, 2011, by Arimoto et al.

* cited by examiner

*Primary Examiner* — Jeffrey Donels
(74) *Attorney, Agent, or Firm* — Morrison & Foerster LLP

(57) ABSTRACT

In a musical analysis apparatus, a spectrum acquirer acquires a spectrum for each frame of an audio signal representing a piece of music. A beat specifier specifies a sequence of beats of the audio signal. A feature amount extractor divides an interval between the beats into a plurality of analysis periods such that one analysis period contains a plurality of frames, and separates the spectrum of the frames contained in one analysis period into a plurality of analysis bands so as to set a plurality of analysis units in one analysis period in correspondence with the plurality of the analysis bands, such that one analysis unit contains components of the spectrum belonging to the corresponding analysis band. The feature amount extractor further calculates a feature value of each analysis unit based on the components of the spectrum contained in each analysis unit, thereby generating a rhythmic feature amount that is an array of the feature values calculated for the analysis units and that features a rhythm of the piece of music.

8 Claims, 7 Drawing Sheets

Ri

| | | | |
|---|---|---|---|
| ri[1,1] | ri[2,1] | .... | ri[M,1] |
| ri[1,2] | ri[2,2] | .... | ri[M,2] |
| ri[1,3] | ri[2,3] | .... | ri[M,3] |
| ⋮ | ⋮ | ⋰ | ⋮ |
| ri[1,N] | ri[2,N] | .... | ri[M,N] |

MUSIC ANALYSIS APPARATUS

BACKGROUND OF THE INVENTION

1. Technical Field of the Invention

The present invention relates to a technology for analyzing rhythms of pieces of music.

2. Description of the Related Art

A technology for analyzing the rhythm of music (i.e., the structure of a temporal array of musical sounds) in order to realize music comparison or search has been suggested in the art. For example, Jouni Paulus and Anssi Klapuri, "Measuring the Similarity of Rhythmic Patterns", Proc. ISMIR 2002, p. 150-156 describes a technology in which the time sequence of the feature amount of each of unit periods (frames) having a predetermined time length, into which an audio signal is divided, is compared between different pieces of music. A DP matching (Dynamic Time Warping (DTW)) technology, which specifies corresponding locations on the time axis (i.e., corresponding time-axis locations) in pieces of music, is employed to compare the feature amounts of pieces of music.

However, the technology disclosed by Jouni Paulus and Anssi Klapuri, "Measuring the Similarity of Rhythmic Patterns", Proc. ISMIR 2002, p. 150-156 has a problem in that the amount of data required to compare pieces of music is large since a feature amount extracted in each unit period of audio signals is used to compare rhythms of pieces of music. In addition, since a feature amount extracted in each unit period is set regardless of the tempo of music, an audio signal extension/contraction process such as the above-mentioned DP matching should be performed to compare the rhythms of pieces of music, causing high processing load.

SUMMARY OF THE INVENTION

The invention has been made in view of these circumstances and it is an object of the invention to reduce processing load required to compare rhythms of pieces of music while reducing the amount of data required to analyze rhythms of pieces of music.

In order to solve the above problems, a musical analysis apparatus according to the invention comprises: a spectrum acquisition part that acquires a spectrum for each unit period of an audio signal representing a piece of music; a beat specification part that specifies a sequence of beats of the audio signal along a time axis; and a feature amount extraction part that divides an interval between the beats into a plurality of analysis periods along the time axis of the audio signal such that one analysis period contains a plurality of the unit periods, and that separates the spectrum of the unit periods contained in one analysis period into a plurality of analysis bands on a frequency axis of the audio signal so as to set a plurality of analysis units in one analysis period in correspondence with the plurality of the analysis bands, such that one analysis unit contains components of the spectrum belonging to the corresponding analysis band, wherein the feature amount extraction part includes a feature calculation part for calculating a feature value of each analysis unit based on the components of the spectrum contained in each analysis unit, thereby generating a rhythmic feature amount that is an array of the feature values calculated for the analysis units arranged in the time axis and in the frequency axis and that features a rhythm of piece of music.

In this configuration, the feature values of the rhythmic feature amount are calculated using analysis periods, each including a plurality of unit periods, as time-axis units and therefore there is an advantage in that the data volume of the rhythmic feature amount is reduced compared to the prior art configuration in which a feature value is calculated for each unit period. In addition, it is possible to compare audio signals with each other with reference to the common time axis even when the audio signals have different tempos, since the analysis periods are defined with reference to beats of the piece of music. Accordingly, compared to the prior art configuration of the technology disclosed by Jouni Paulus and Anssi Klapuri, "Measuring the Similarity of Rhythmic Patterns", Proc. ISMIR 2002, p. 150-156 in which there is a need to match the time axis of each audio signal to be compared, there is an advantage in that processing load required to compare the rhythms of pieces of music is reduced. The term "piece of music" or "music" used in the specification refers to a set of musical sounds or vocal sound arranged in a time series, no matter whether it is all or part of a piece of music created as a single work. Although the frequency bandwidth of each analysis band is arbitrary, it is preferable to employ a configuration in which each analysis band is set to a bandwidth corresponding to, for example, one octave.

In the musical analysis apparatus according to a preferred aspect of the invention, the feature amount extraction part generates a first rhythmic feature amount that features a rhythm of a first audio signal, and generates a second rhythmic feature amount that features a rhythm of a second audio signal, wherein the musical analysis apparatus further comprises a feature comparison part that calculates a similarity index value indicating similarity between the rhythm of the first audio signal and the rhythm of the second audio signal by comparing the first rhythmic feature amount and the second rhythmic feature amount with each other.

In this aspect, it is possible to quantitatively estimate whether or not the rhythms of the first audio signal and the second audio signal are similar since the similarity index value is calculated by comparing the rhythmic feature amounts of the first audio signal and the second audio signal.

In a first aspect of the invention, the feature comparison part comprises: a difference calculation part that calculates, for each of the analysis units, an element value corresponding to a difference between each feature value of the first rhythmic feature amount and each feature value of the second rhythmic feature amount; a correction value calculation part that calculates a first correction value of each analysis period based on a plurality of feature values which are obtained in same analysis period of the first audio signal and which correspond to different analysis bands of the same analysis period among feature values of the rhythmic feature amount of the first audio signal, and that calculates a second correction value of each analysis period based on a plurality of feature values which are obtained in same analysis period of the second audio signal and which correspond to different analysis bands of the same analysis period among feature values of the rhythmic feature amount of the second audio signal; a correction part that applies the first correction value of each analysis period generated for the first audio signal and the second correction value of each analysis period generated for the second audio signal to the element value of each analysis period; and an index calculation part that calculates the similarity index value from the element values after being processed by the correction part.

The feature comparison part may further comprise: another correction value calculation part that calculates a first correction value of each analysis band of the first audio signal based on a plurality of feature values which belong to same analysis band and which correspond to different analysis periods of the same analysis band among feature values of the rhythmic feature amount of the first audio signal, and that calculates a second correction value of each analysis band of the second audio signal based on a plurality of feature values which belong to same analysis band and which correspond to different analysis periods of the same analysis band among feature values of the rhythmic feature amount of the second audio signal; another correction part that applies the first correction value of each analysis band generated for the first audio signal and the second correction value of each analysis band generated for the second audio signal to the element value of each analysis band; and the index calculation part that calculates the similarity index value from the element values after being processed by the correction part.

In the first aspect, the distribution of the difference of the feature values of the rhythmic feature amount of the first audio signal and the rhythmic feature amount of the second audio signal in the direction of the time axis is corrected using the correction value and the distribution thereof in the direction of the frequency axis is corrected using the other correction value. Accordingly, for example, by calculating the similarity index value so as to equalize the distribution in the frequency axis while emphasizing the distribution in the direction of the time axis, it is possible to compare rhythms from various viewpoints.

In a second aspect of the invention, the feature amount extraction part comprises: a correction value calculation part that calculates a correction value of each analysis period based on a plurality of feature values which are obtained for same analysis period and which correspond to different analysis bands of the same analysis period among feature values calculated by the feature calculation part; and a correction part that applies the correction value of each analysis period to each feature value of the corresponding analysis period for correcting each feature value.

The feature amount extraction part may further comprise: another correction value calculation part that calculates a correction value of each analysis band based on a plurality of feature values which are obtained for same analysis band and which correspond to different analysis periods of the same analysis band among feature values calculated by the feature calculation part; and another correction part that applies the other correction value of each analysis band to each feature value of the corresponding analysis band for correcting each feature value.

In the second aspect, the distribution, in the direction of the time axis, of the feature values calculated by the feature calculation part is corrected using the correction value and the distribution in the direction of the frequency axis is corrected using the other correction value. Accordingly, for example, by calculating the rhythmic feature amount so as to equalize the distribution in the frequency axis while emphasizing the distribution in the direction of the time axis, it is possible to generate a rhythmic feature amount suiting various needs.

In each of the above aspects, the invention may also be specified as a musical analysis apparatus that compares rhythmic feature amounts generated for audio signals with each other. A musical analysis apparatus that is suitable for comparing rhythms of pieces of music comprises: a storage part that stores a rhythmic feature amount for each of a first audio signal representing a piece of music and a second audio signal representing another piece of music, the rhythmic feature amount comprising an array of feature values of analysis units arranged two-dimensionally on a time axis and a frequency axis, each of the analysis units being defined at each of a plurality of analysis periods in the time axis and at each of a plurality of analysis bands in the frequency axis, the plurality of analysis periods being set by dividing an interval between beats of the piece of music such that one analysis period contains spectrum of a plurality of unit periods of the audio signal, the spectrum of one analysis period being separated into a plurality of analysis bands such that one analysis unit defined at one analysis period and at one analysis band contains components of the spectrum, the feature value of one analysis unit representing the components of the spectrum contained in the one analysis unit; and a feature comparison part that calculates a similarity index value indicating similarity between rhythms of the first audio signal and the second audio signal by comparing the respective rhythmic feature amounts of the first audio signal and the second audio signal.

In this aspect, the feature values of the rhythmic feature amount are calculated respectively for analysis periods, each including a plurality of unit periods, as time-axis units and therefore there is an advantage in that the amount of data required for the storage part is reduced compared to the prior art configuration in which a feature value is calculated for each unit period. In addition, it is possible to contrast audio signals with each other with reference to the common time axis even when the audio signals have different tempos since analysis periods are normalized with reference to beats of the piece of music. Accordingly, there is an advantage in that processing load required to compare the rhythms of pieces of music is reduced.

The musical analysis apparatus according to each of the above aspects may not only be implemented by hardware (electronic circuitry) such as a Digital Signal Processor (DSP) dedicated to analysis of music but may also be implemented through cooperation of a general arithmetic processing unit such as a Central Processing Unit (CPU) with a program. A program according to the invention is executable by a computer to perform processes of: acquiring a spectrum for each unit period of an audio signal representing a piece of music; specifying a sequence of beats of the audio signal along a time axis; dividing an interval between the beats into a plurality of analysis periods along the time axis of the audio signal such that one analysis period contains a plurality of the unit periods; separating the spectrum of the unit periods contained in one analysis period into a plurality of analysis bands on a frequency axis of the audio signal so as to set a plurality of analysis units in one analysis period in correspondence with the plurality of the analysis bands, such that one analysis unit contains components of the spectrum belonging to the corresponding analysis band; calculating a feature value of each analysis unit based on the components of the spectrum contained in each analysis unit; and generating a rhythmic feature amount that is an array of the feature values calculated for the analysis units arranged two-dimensionally in the time axis and the frequency axis and that features a rhythm of the audio signal.

The program achieves the same operations and advantages as those of the musical analysis apparatus according to the invention. The program of the invention may be provided to a user through a computer readable storage medium storing the program and then installed on a computer and may also be provided from a server device to a user through distribution over a communication network and then installed on a computer.

DETAILED DESCRIPTION OF THE INVENTION

<A: First Embodiment>

Figure 1:
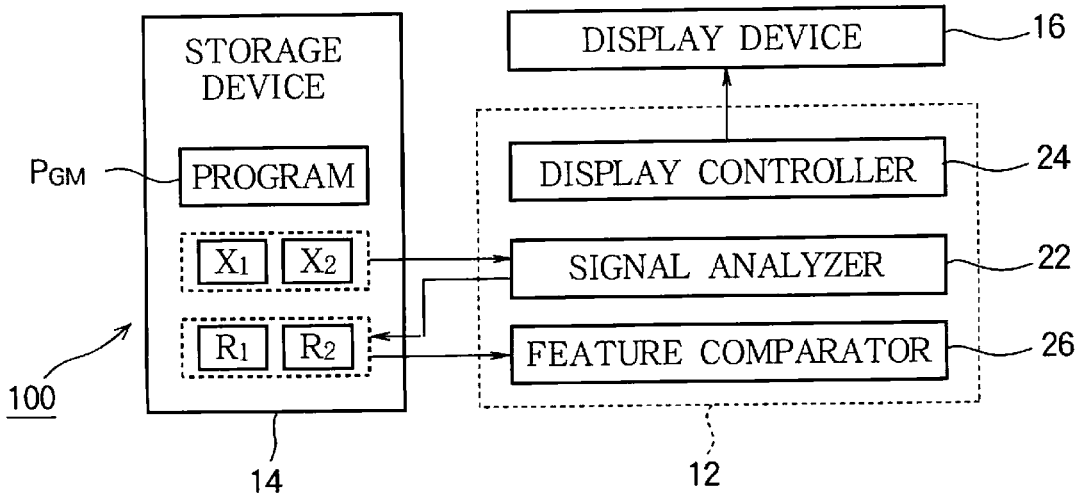
FIG. 1 is a block diagram of a musical analysis apparatus according to a first embodiment of the invention.

FIG. 1 is a block diagram of a musical analysis apparatus 100 according to a first embodiment of the invention. The musical analysis apparatus 100 is a device for analyzing the rhythm of music (i.e., the structure of a temporal array of musical sounds) and is implemented through a computer system including an arithmetic processing unit 12, a storage device 14, and a display device 16.

The storage device 14 stores various data used by the arithmetic processing unit 12 and a program PGM executed by the arithmetic processing unit 12. Any known machine readable storage medium such as a semiconductor recording medium or a magnetic recording medium or a combination of various types of recording media may be employed as the storage device 14.

As shown in FIG. 1, the storage device 14 stores an audio signal X1 and an audio signal X2. The audio signal Xi (i=1, 2) is a signal representing temporal waveforms of musical sounds such as singing sounds or musical performance sounds included in a piece of music and is prepared for a section having a sufficient time length, from which it is possible to specify the rhythm of the piece of music (for example, a specific number of measures in the piece of music). The audio signal X1 and the audio signal X2 may have different rhythms. For example, the audio signal X1 and the audio signal X2 represent parts of individual pieces of music having different rhythms. However, it is also possible to employ a configuration in which the first audio signal X1 and the second audio signal X2 represent individual parts of a single piece of music or a configuration in which the audio signal Xi represents the entirety of a piece of music.

The arithmetic processing unit 12 implements a plurality of functions (including a signal analyzer 22, a display controller 24, and a feature comparator 26) required to analyze or compare the rhythm of each audio signal Xi through execution of the program PGM stored in the storage device 14. The signal analyzer 22 generates a rhythmic feature amount Ri(R1, R2) representing the feature of the rhythm of the audio signal Xi. The display controller 24 displays the rhythmic feature amount Ri generated by the signal analyzer 22 as an image pattern on the display device 16 (for example, a liquid crystal display). The feature comparator 26 compares the rhythmic feature amount R1 of the first audio signal X1 and the rhythmic feature amount R2 of the second audio signal X2. It is also possible to employ a configuration in which each function of the arithmetic processing unit 12 is implemented through a dedicated electronic circuit (DSP) or a configuration in which each function of the arithmetic processing unit 12 is distributed on a plurality of integrated circuits.

Figure 2:
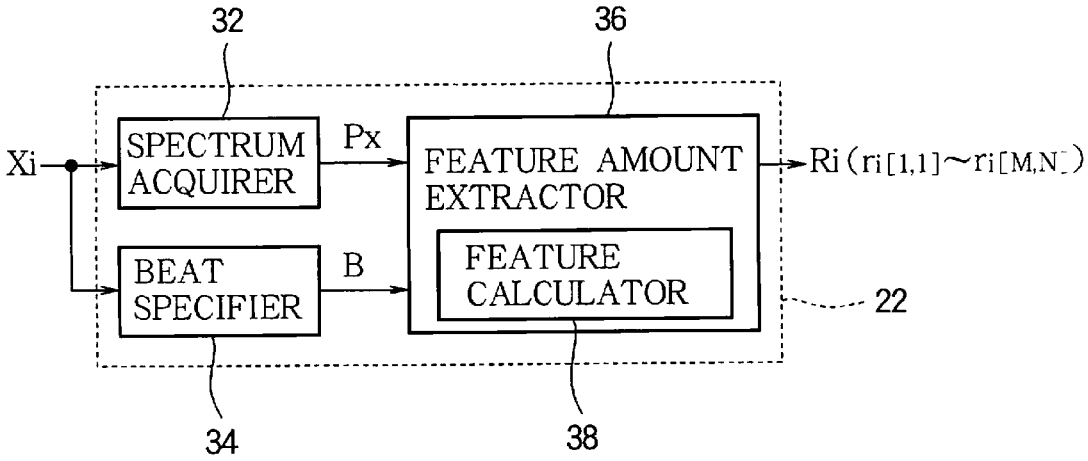
FIG. 2 is a block diagram of a signal analyzer.

FIG. 2 is a block diagram of the signal analyzer 22. As shown in FIG. 2, the signal analyzer 22 includes a spectrum acquirer 32, a beat specifier 34, and a feature amount extractor 36. The spectrum acquirer 32 generates a spectrum (for example, a power spectrum) PX of the frequency domain for each of the unit periods (specifically, frames) having a predetermined length, into which the audio signal Xi is divided on the time axis.

Figure 3:
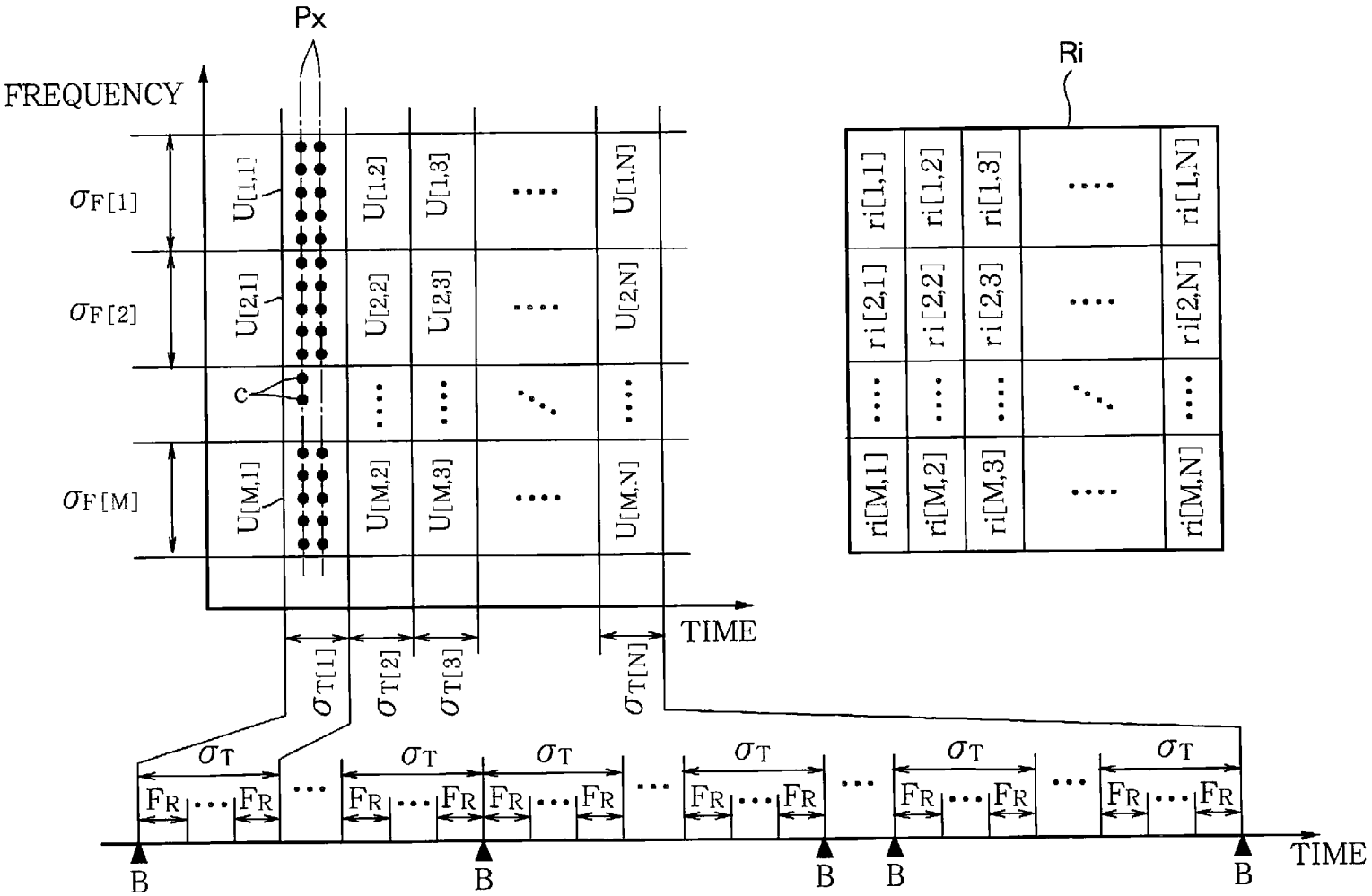
FIGS. 3(A) and 3(B) are a schematic diagram illustrating relationships between analysis units and rhythmic feature amounts.

FIG. 3(A) is a schematic diagram of a time sequence (i.e., a spectrogram) of the spectrum PX generated by the spectrum acquirer 32. As shown in FIG. 3(A), the spectrum PX of each unit period FR of the audio signal Xi is a series of values of a plurality of component values (powers) c corresponding to different frequencies on the frequency axis. Any known frequency analysis such as, for example, short time Fourier transform may be employed to generate the spectrum PX of each unit period FR.

The beat specifier 34 of FIG. 2 specifies beats B of the audio signal Xi. The beats B are time points on the time axis that are used as basic units of the rhythm of a piece of music. As shown in FIG. 3(A), basically, beats B are set on the time axis at regular intervals. Any known technology may be employed to detect the beats B. For example, the beat specifier 34 specifies time points which are spaced at approximately equal intervals and at which the magnitude of the audio signal Xi is maximized on the time axis. It is also possible to employ a configuration in which the user designates beats B on the audio signal Xi through manipulation of an input device (not shown).

The feature amount extractor 36 of FIG. 2 generates the rhythmic feature amount Ri of the audio signal Xi using each beat B specified by the beat specifier 34 and each spectrum PX generated by the spectrum acquirer 32. As shown in FIG. 3(B), the rhythmic feature amount Ri is represented as a matrix of feature values ri[m, n] arranged in M rows and N columns (m=1~M, n=1~N). The feature amount extractor 36 of the first embodiment includes a feature calculator 38 that calculates the feature values ri[m, n] (ri[1, 1] to ri[M, N]).

The feature calculator 38 defines regions (hereinafter referred to as "analysis units") U[1, 1] to U[M, N] that are arranged in an M×N matrix in the time-frequency plane and calculates a feature value ri[m, n](ri[1, 1] to ri[M, N]) of the rhythmic feature amount Ri for each analysis unit U[m, n]. The analysis unit U[m, n] is a region at the intersection of an mth analysis band σF[m] among M bands (hereinafter referred to as "analysis bands") σF[1] to σF[M] set on the frequency axis and an nth analysis period σT[n] among N periods (hereinafter referred to as "analysis periods") σT[1] to σT[N] set on the time axis.

As shown in FIG. 3(A), the feature calculator 38 sets M analysis bands σF[1] to σF[M] on the frequency axis so that each analysis band σF[m] includes a plurality of component values c of one spectrum PX. Specifically, each of the analysis bands σF[1] to σF[M] is set to a bandwidth corresponding to one octave. It is also possible to employ a configuration in which each of the analysis bands σF[1] to σF[M] is set to a bandwidth corresponding to a multiple of one octave or a bandwidth corresponding to a division of one octave divided by an integer.

In addition, the feature calculator 38 sets k sections (k: a natural number greater than 1), into which the interval between each adjacent beat B is equally divided on the time axis, as N analysis periods σT[1] to σT[N]. Accordingly, the total number N of analysis periods σT[n] is represented by {(NB−1)×k} using the total number NB of beats B specified by the beat specifier 34. As shown in FIG. 3(A), each analysis period σT[n] includes a plurality of unit periods FR.

For example, the analysis periods σT[1] to σT[N] are set respectively to 16 period lengths (i.e., k=16), into which the interval between adjacent beat points B of the audio signal Xi is equally divided. Assuming that the interval between the adjacent beat points B corresponds to the time period of a quarter note in a piece of music, one of the 16 analysis periods σT[n] into which the interval of each beat B is equally divided corresponds to the time length of a sixty-fourth note in the piece of music. Accordingly, the time length of the analysis period σT[n] (i.e., the number of unit periods FR in the analysis period σT[n]) varies depending on the tempo of the piece of music represented by the audio signal Xi. That is, the analysis period σT[n] is set to a shorter time length as the tempo of the piece of music increases (i.e., as the interval of each beat B decreases).

The feature calculator 38 of FIG. 2 calculates a rhythmic feature value ri[m, n](ri[1, 1] to ri[M, N]) of the rhythmic feature amount Ri from a plurality of component values c belonging to an analysis unit U[m, n] among the time sequence of the spectrum PX of the audio signal Xi. Specifically, the feature calculator 38 calculates, as a feature value ri[m, n], an average (arithmetic average) of a plurality of component values c in the analysis band σF[m] in the spectrum PX of the unit periods FR in the analysis period σT[n]. Accordingly, the feature value ri[m, n] is set to a higher value as the strength of the components of the analysis band σF[m] in the audio signal Xi increases.

The signal analyzer 22 of FIG. 1 sequentially generates rhythmic feature amounts Ri (R1, R2) for the audio signal X1 and the audio signal X2 through the above procedure. The rhythmic feature amounts Ri generated by the signal analyzer 22 are stored in the storage device 14.

Figure 4:
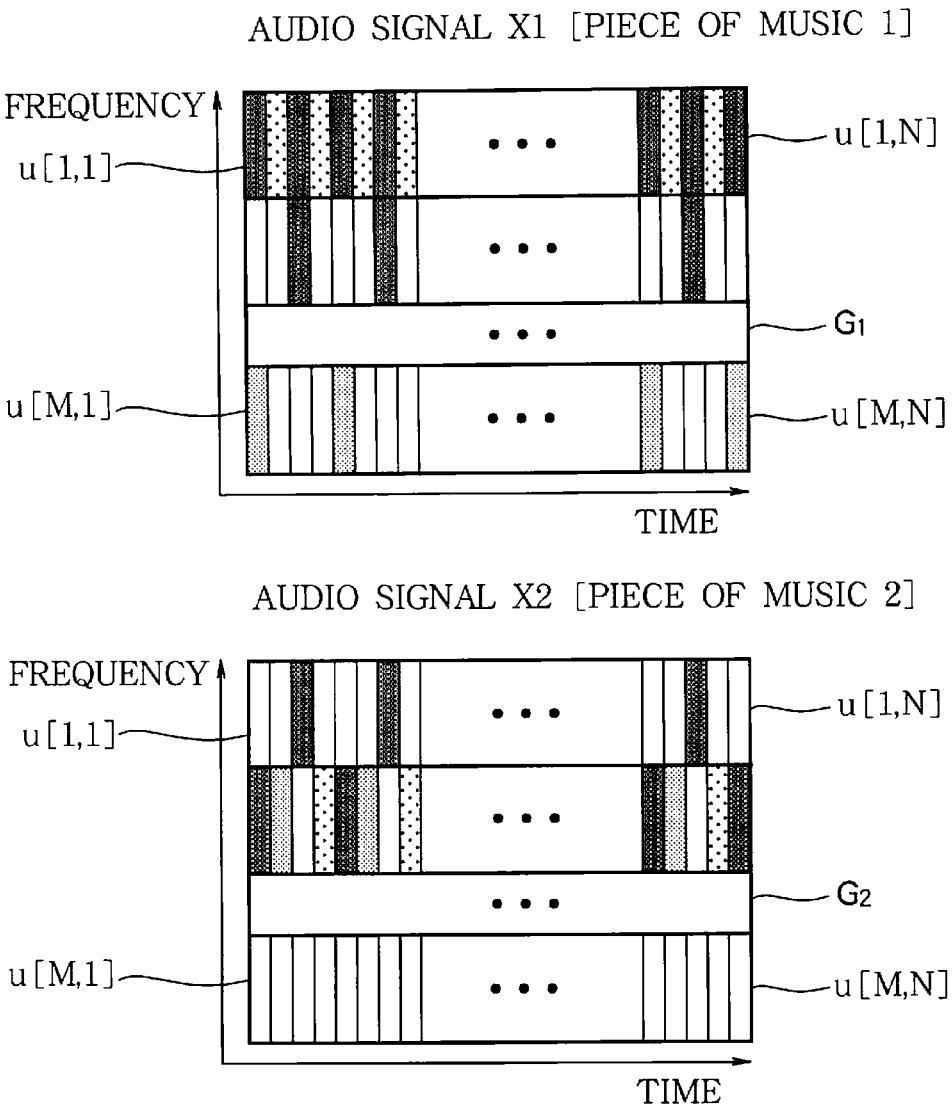
FIG. 4 is a schematic diagram of a rhythm image.

The display controller 24 displays images of FIG. 4 schematically representing the rhythmic feature amounts Ri (R1, R2) generated by the signal analyzer 22 on the display device 16. The rhythm image Gi illustrated in FIG. 4 is an image pattern in which unit figures u[m, n] corresponding to the analysis units U[m, n] are mapped in an M×N matrix including M rows and N columns along the time axis (horizontal axis) and the frequency axis (vertical axis) that are perpendicular to each other. As shown in FIG. 4, a rhythm image G1 of the rhythmic feature amount R1 of the audio signal X1 and a rhythm image G2 of the rhythmic feature amount R2 of the audio signal X2 are displayed in parallel with respect to the common time axis. This allows the user to visually estimate whether or not the rhythms of the audio signal X1 and the audio signal X2 are similar.

A display form (color or gray level) of a unit figure u[m, n] located at an mth row and an nth column in each rhythm image Gi is variably set according to a feature value ri[m, n] in the rhythmic feature amount Ri. In FIG. 4, each feature value ri[m, n] is clearly represented by a gray level of a unit figure u[m, n]. Since the unit figures u[m, n] representing the rhythmic feature values ri[m, n] are arranged in a matrix form so as to correspond to the arrangement of the analysis units U[m, n] in the time-frequency plane as described above, there is an advantage in that the user can intuitively identify combinations (i.e., rhythmic patterns) of the time points (corresponding to analysis periods σT[n]) at which musical sounds in the analysis bands σF[n] are generated and the strengths (the rhythmic feature values ri[m, n]) of the musical sounds.

In addition, since the analysis periods σT[n], which are time-axis units of the feature values ri[m, n], are normalized based on the beats B of each piece of music, the position or dimension (horizontal width) of each unit figure u[m, n] in the direction of the time axis is common to the rhythm image G1 and the rhythm image G2 even when the pieces of music of the audio signal X1 and the audio signal X2 have different tempos. Accordingly, there is an advantage in that it is possible to easily compare the rhythms of the audio signal X1 and the audio signal X2 along the common time axis even when the tempos of the audio signal X1 and the audio signal X2 are different.

Figure 5:
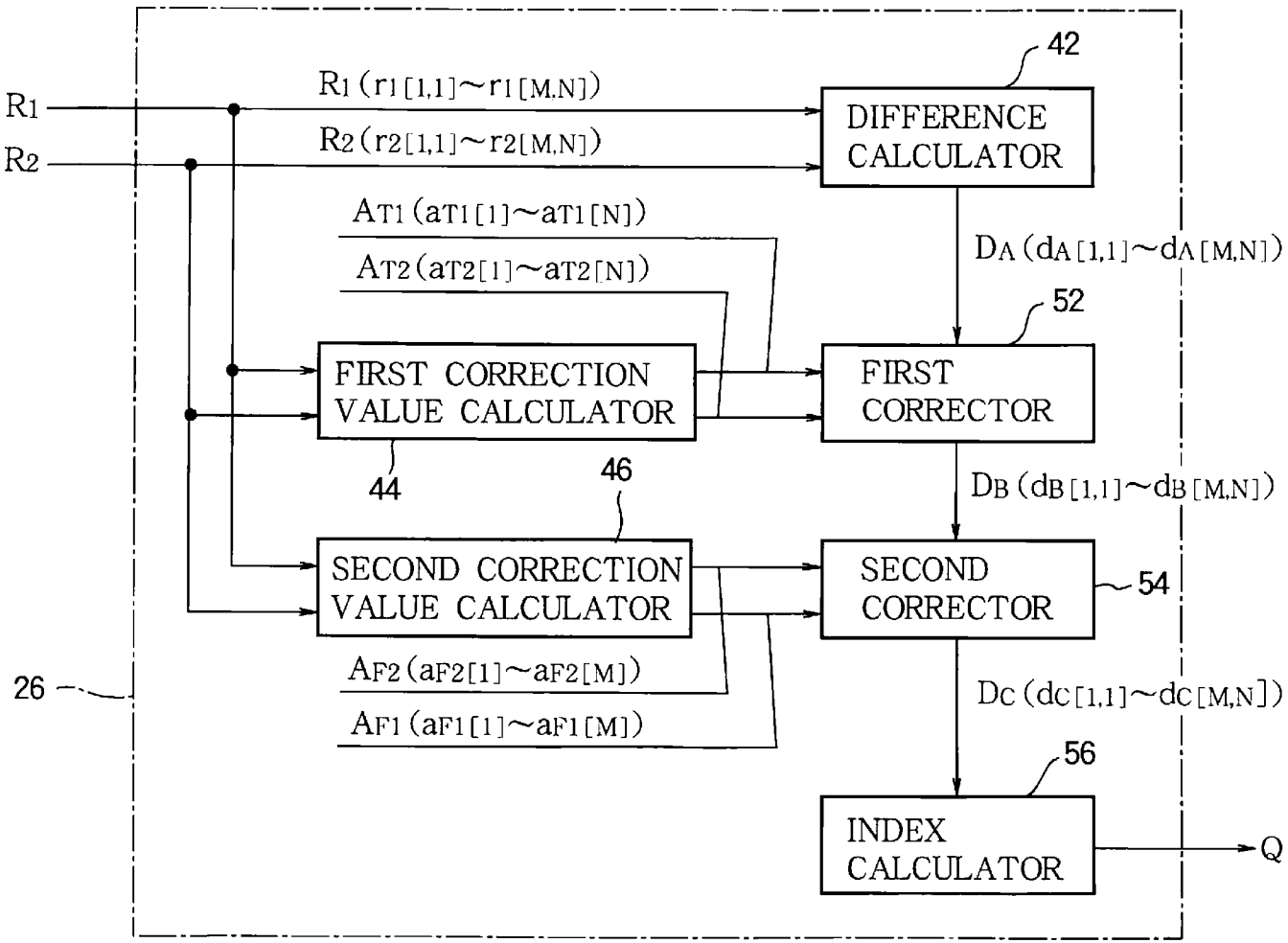
FIG. 5 is a block diagram of a feature comparator.
Figure 6:
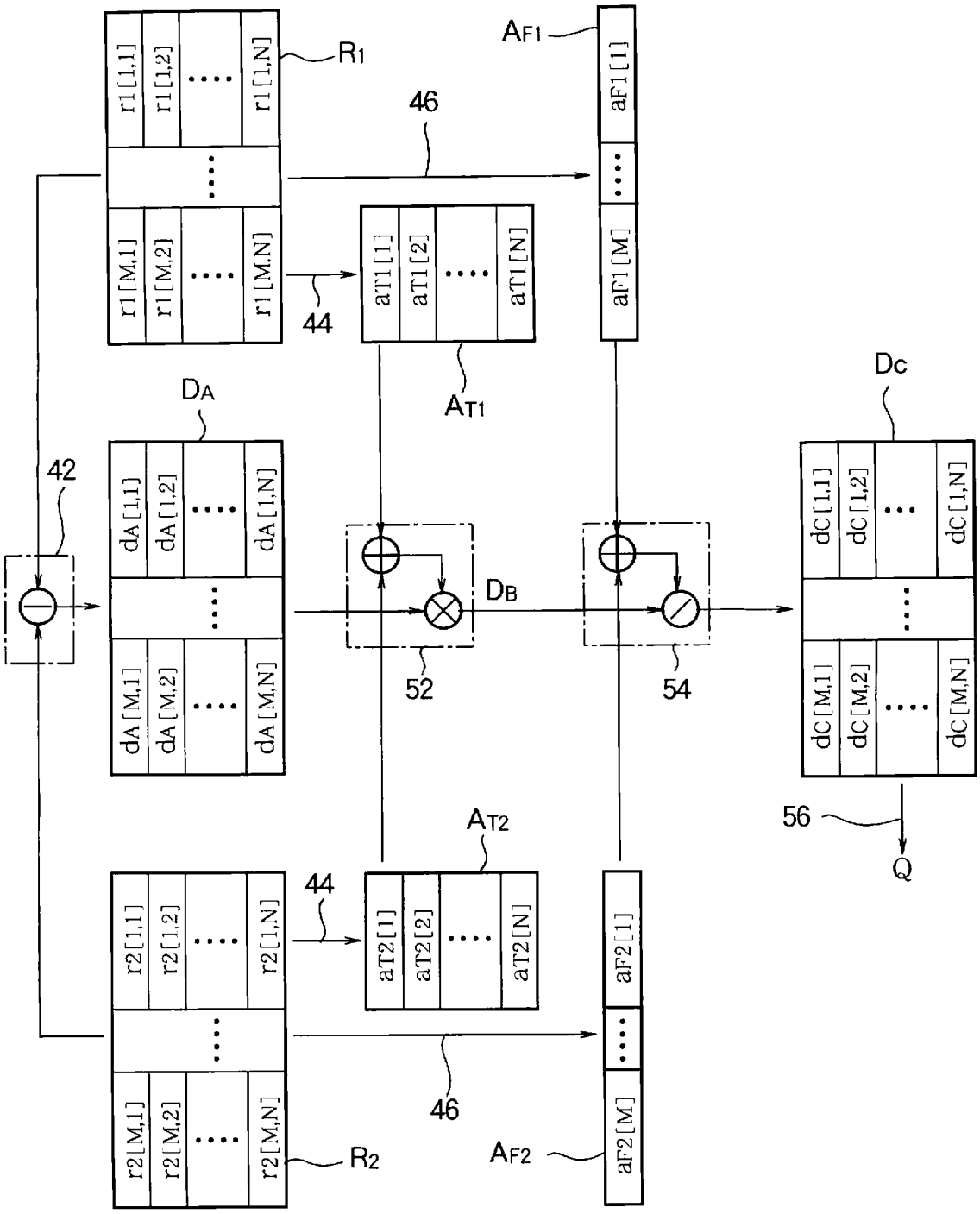
FIG. 6 is a diagram illustrating operation of the feature comparator.

The feature comparator 26 of FIG. 1 calculates a value (hereinafter referred to as a "similarity index value") Q which is a measure of the rhythm similarity between the audio signal X1 and audio signal X2 by comparing the rhythmic feature amount R1 (r1[1, 1] to r1[M, N]) of the audio signal X1 and the rhythmic feature amount R2 (r2[1, 1] to r2[M, N]) of the audio signal X2. FIG. 5 is a block diagram of the feature comparator 26 and FIG. 6 illustrates operation of the feature comparator 26. As shown in FIG. 5, the feature comparator 26 includes a difference calculator 42, a first correction value calculator 44, a second correction value calculator 46, a first corrector 52, a second corrector 54, and an index calculator 56. In FIG. 6, the reference numbers of the elements of the feature comparator 26 are written at locations corresponding to processes performed by these elements.

The difference calculator 42 of FIG. 5 generates a difference value sequence DA corresponding to the difference between the rhythmic feature amount R1 and the rhythmic feature amount R2. The difference value sequence DA is a matrix of element values dA[1, 1] to dA[M, N] arranged in M rows and N columns as shown in FIG. 6. The element value dA[m, n] is an absolute value of a value obtained by subtracting an average value rA[m] from a difference δ[m, n] (δ[m, n]=r1[m, n]−r2[m, n]) between the feature value r1[m, n] of the rhythmic feature amount R1 and the feature value r2[m, n] of the rhythmic feature amount R2 as shown in the following Equation (A1). The average value rA[m] is an average of the N differences δ[m, 1] to δ[m, n] corresponding to the analysis band σF[m].

$$dA[m, n]=|\delta[m, n]-rA[m]| \quad \text{(A1)}$$

The first correction value calculator 44 of FIG. 5 generates correction value sequences ATi(AT1, AT2) for the audio signal X1 and the audio signal X2, respectively. As shown in FIG. 6, the correction value sequence ATi is a sequence of N correction values aTi[1] to aTi[N] corresponding to the analysis periods σT[1] to σT[N]. The nth correction value aTi[n] of the correction value sequence ATi is calculated according to M feature values ri[1, n] to ri[M, n] corresponding to the analysis periods σT[n] of the rhythmic feature amount Ri of the audio signal Xi. For example, the sum or average of the M feature values ri[1, n] to ri[M, n] is calculated as the correction value aTi[n]. Accordingly, the correction value aTi[n] of the correction value sequence ATi increases as the strength of the components of the analysis periods σT[n] increases over all bands of the audio signal Xi.

The second correction value calculator 46 of FIG. 5 generates correction value sequences AFi(AF1, AF2) for the audio signal X1 and the audio signal X2, respectively. As shown in FIG. 6, the correction value sequence AFi is a sequence of M correction values aFi[1] to aFi[M] corresponding to the analysis bands σF[1] to σF[M]. The mth correction value aFi[m] of the correction value sequence AFi is calculated according to N feature values ri[m, 1] to ri[m, N] corresponding to the analysis bands σF[m] of the rhythmic feature amount Ri of the audio signal Xi. For example, the average or sum of the absolute values of N values obtained by subtracting averages rA1[m] of N feature values ri[m, 1] to ri[m, N] from the N feature values ri[m, 1] to ri[m, N] is calculated as the correction value aFi[m]. Accordingly, the correction value aFi[m] of the correction value sequence AFi increases as the strength of the components of the analysis bands σF[m] increases over all periods of the audio signal Xi.

The first corrector 52 of FIG. 5 generates a difference value sequence DB, which is a matrix of M rows and N columns including element values dB'[1, 1] to dB[M, N], by applying the correction value sequence AT1 and the correction value sequence AT2 generated by the first correction value calculator 44 to the difference value sequence DA generated by the difference calculator 42. Specifically, as shown in the following Equation (A2) and FIG. 6, the element values dB[m, n] of the nth column of the difference value sequence DB is set to values obtained by multiplying the element values dA[m, n] of the nth column of the difference value sequence DA by the sum (aT1[n]+aT2[n]) of the correction value sequence AT1 and the correction value sequence AT2. Accordingly, the element values dB[m, n] of the difference value sequence DB are more emphasized than the element values dA[m, n] of the difference value sequence DA as the strength of the audio signal X1 or the audio signal X2 in the analysis period σT[n] increases. That is, the first corrector 52 functions as an element for correcting the distribution of the element values dA[m, 1] to dA[m, N] arranged in the direction of the time axis.

$$dB[m, n]=dA[m, n]\times(aT1[n]+aT2[n]) \quad \text{(A2)}$$

The second corrector 54 of FIG. 5 generates a difference value sequence DC by applying the correction value sequence AF1 and the correction value sequence AF2 generated by the second correction value calculator 46 to the difference value sequence DB corrected by the first corrector 52. The difference value sequence DC is represented as a matrix of M rows and N columns including element values dC[1, 1] to dC[M, N] as shown in FIG. 6. As shown in the following Equation (A3) and FIG. 6, the element values dC[m, n] of the difference value sequence DC are set to values obtained by dividing the element values dB[m, n] of the difference value sequence DB by the sum (aF1[m]+aF2[m]) of the correction value sequence AF1 and the correction value sequence AF2. Accordingly, the difference (or variance) of the element value dC[m, n] of each analysis band σF[m] in the difference value sequence DC is reduced (i.e., the element value dC[m, n] is more leveled or equalized) than that of the element value dB[m, n] of the difference value sequence DB. That is, the second corrector 54 functions as an element for correcting the distribution of the element values dB[1, n] to dB[M, n] arranged in the direction of the frequency axis.

$$dC[m, n]=dB[m, n]/(aF1[m]+aF2[m]) \quad \text{(A3)}$$

As can be understood from the above description, the element value dC[m, n] of the difference value sequence DC corrected by the second corrector 54 increases as the difference between the feature value r1[m, n] of the audio signal X1 and the feature value r2[m, n] of the audio signal X2 increases. In addition, in the difference value sequence DC, the element value dC[m, n] of the analysis period σT[n] is more emphasized as the strength of each audio signal Xi increases and the influence of the difference of strength of each analysis band σF[m] in each audio signal Xi also decreases.

The index calculator 56 of FIG. 5 calculates a similarity index value Q from the difference value sequence DC (element values dC[1, 1] to dC[M, N]) corrected by the second corrector 54. Specifically, the index calculator 56 calculates a similarity index value Q (a single scalar value) by summing or averaging the respective averages (sums) of the N element values dC[m, 1] to dC[m, N] of each analysis band σF[m] over the M analysis bands σF[1] to σF[M]. As can be understood from the above description, the similarity index value Q decreases as the similarity between the rhythmic feature amount R1 of the audio signal X1 and the rhythmic feature amount R2 of the audio signal X2 increases. The similarity index value Q calculated by the index calculator 56 is displayed on the display device 16. The user recognizes the rhythm similarity between the audio signal X1 and the audio signal X2 by reading the similarity index value Q.

In the above embodiment, there is an advantage in that the amount of data of the rhythmic feature amount Ri is reduced compared to the prior art configuration in which the rhythmic feature value is calculated for each unit period FR since the N rhythmic feature values ri [m, n] (ri[m, 1] to ri[m, N]) of the rhythmic feature amount Ri are calculated respectively for analysis periods σT[n], each including a plurality of unit periods FR, as time-axis units. In addition, since the analysis periods σT[n] are set based on the beats B of the piece of music (i.e., are set to sections into which the interval between adjacent beat points B is equally divided), the rhythmic feature amount R1 and the rhythmic feature amount R2 may be contrasted with each other with reference to the common time axis even when the audio signal X1 and the audio signal X2 have different tempos. That is, in principle, the audio signal expansion/contraction process required to match the time axis of each audio signal for rhythm comparison in the technology disclosed by Jouni Paulus and Anssi Klapuri, "Measuring the Similarity of Rhythmic Patterns", Proc. ISMIR 2002, p. 150-156 is unnecessary in the first embodiment. Accordingly, there is an advantage in that processing load required to compare the rhythms of pieces of music is reduced.

Further, since M rhythmic feature values ri[m, n] (ri[1, n] to ri[M, n]) of the rhythmic feature amount Ri are calculated respectively for analysis bands σF[m], each having a bandwidth including a plurality of component values c of the spectrum PX, as frequency-axis units, there is an advantage in that the amount of data is reduced compared to the configuration in which each component value c on the frequency axis is used as a rhythmic feature amount Ri. In addition, in the first embodiment, there is an advantage in that it is possible to easily identify the rhythms of musical instruments having different ranges from the rhythmic feature amounts Ri since the analysis band σF[m] is set to one octave.

In the first embodiment of the invention, the feature comparison part includes a difference calculation part that calculates, for each of the analysis units, an element value (for example, an element value dA[m, n] of FIG. 6) corresponding to a feature value difference between the rhythmic feature amount of the first audio signal and the rhythmic feature amount of the second audio signal, a first correction value calculation part that calculates, for each of the first audio signal and the second audio signal, a first correction value (for example, a first correction value aTi[n, 1] of FIG. 6) of each analysis period based on a plurality of feature values (for example, feature values ri[1, , n] to ri[M, n] of FIG. 6) corresponding to different analysis bands among feature values of the rhythmic feature amount of the audio signal, a second correction value calculation part that calculates, for each of the first audio signal and the second audio signal, a second correction value (for example, a second correction value aFi [m] of FIG. 6) of each analysis band based on a plurality of feature values (for example, feature values ri[m, 1] to ri[n, N] of FIG. 6) corresponding to different analysis periods among feature values of the rhythmic feature amount of the audio signal, a first correction part that applies the first correction value of each analysis period generated for each of the first audio signal and the second audio signal to the element value of the analysis period, a second correction part that applies the second correction value of each analysis band generated for each of the first audio signal and the second audio signal to the element value of the analysis band, and an index calculation part that calculates the similarity index value from the element values after being processed by the first correction part and the second correction part.

In addition, the first embodiment may be divided into a configuration (no matter whether the second correction value calculation part or the second correction part is present or absent) in which the feature comparison part includes the difference calculation part, the first correction value calculation part, the first correction part, and the index calculation part, and another configuration (no matter whether the first correction value calculation part or the first correction part is present or absent) in which the feature comparison part includes the difference calculation part, the second correction value calculation part, the second correction part, and the index calculation part.

<B: Second Embodiment>

Reference will now be made to the second embodiment of the invention. In the first embodiment, the rhythmic feature amount Ri generated by the signal analyzer 22 is corrected using the correction value sequence ATi and the other correction value sequence AFi upon comparison by the feature comparator 26. In the second embodiment, the rhythmic feature amount Ri obtained through correction by the feature comparator 26 is generated by the signal analyzer 22. In each of the following examples, elements whose operations and functions are similar to those of the first embodiment will be denoted by the reference numerals or symbols used in the above description and a detailed description thereof will be omitted as appropriate.

Figure 7:
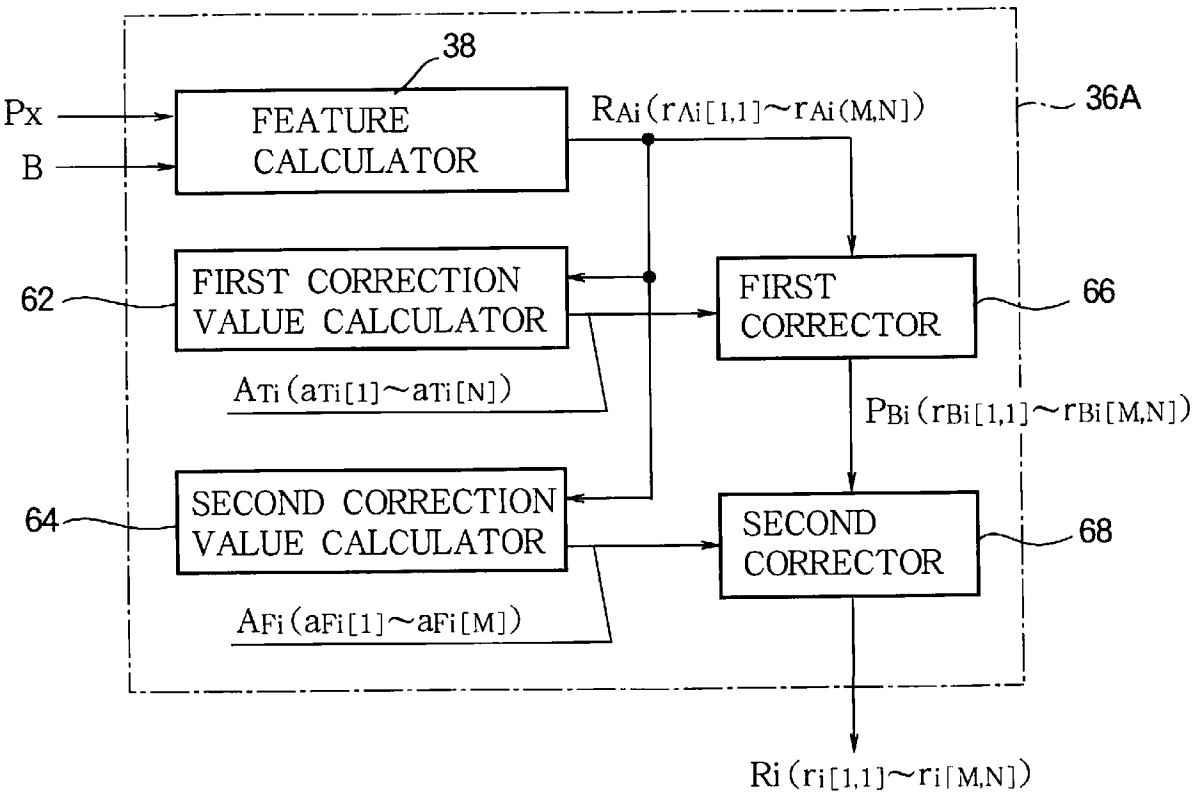
FIG. 7 is a block diagram of a signal analyzer in a second embodiment.
Figure 8:
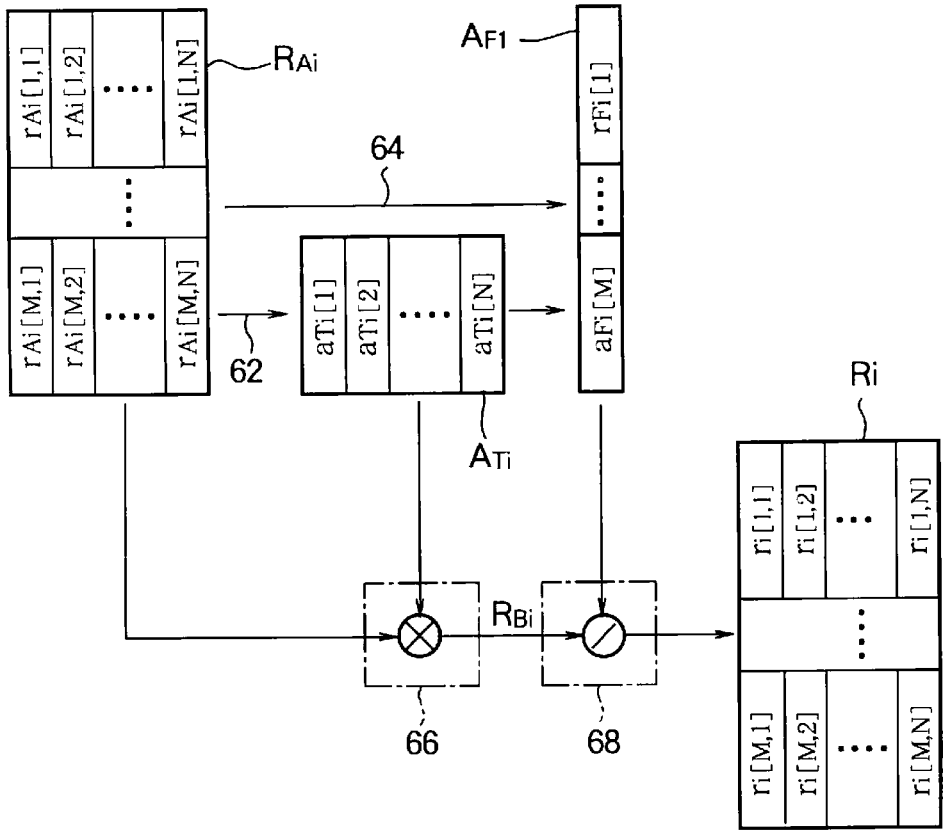
FIG. 8 is a diagram illustrating operation of the signal analyzer.

FIG. 7 is a block diagram of the feature amount extractor 36A in the second embodiment. FIG. 8 illustrates operation of the feature amount extractor 36A. As shown in FIG. 7, the feature amount extractor 36A of the second embodiment includes a first correction value calculator 62, a second correction value calculator 64, a first corrector 66, and a second corrector 68 in addition to the elements of the feature amount extractor 36 of the first embodiment. The feature calculator 38 generates feature values rAi[1, 1] to rAi[M, N] of the rhythmic feature amount RAi using the same method as when the rhythmic feature values ri[1, 1] to ri[M, N] are calculated in the first embodiment. The rhythmic feature amount Ri (feature values ri[m, n]) of the first embodiment and the rhythmic feature amount RAi (feature values rAi[m, n]) of the second embodiment are denoted by different reference symbols for ease of explanation although the rhythmic feature amount Ri (feature values ri[m, n]) and the rhythmic feature amount RAi (feature values rAi[m, n]) are identical.

The first correction value calculator 62 of FIG. 7 generates a correction value sequence ATi corresponding to the rhythmic feature amount RAi, which is a sequence of first correction values aTi[1] to aTi[N], using the same method as the first correction value calculator 44 of the first embodiment. That is, the nth correction value aTi[n] of the correction value sequence ATi is calculated by averaging or summing M feature values rAi[1, n] to rAi[M, n] of the nth column of the rhythmic feature amount RAi, similar to the first embodiment. Accordingly, the correction value aTi[n] of the correction value sequence ATi increases as the strength (or volume) of the analysis period σT[n] over all bands of the audio signal Xi increases.

The second correction value calculator 64 of FIG. 7 generates a correction value sequence AFi corresponding to the rhythmic feature amount RAi, which is a sequence of second correction values aFi[1] to aFi[M], using the same method as the second correction value calculator 46 of the first embodiment as shown in FIG. 8. That is, the mth correction value aFi[m] of the correction value sequence AFi is calculated by averaging or summing N feature values rAi[m, 1] to rAi[m, N] of the mth column of the rhythmic feature amount RAi, similar to the first embodiment. Accordingly, the correction value aFi[m] of the correction value sequence AFi increases as the strength of the component of the analysis band σF[m] over all periods of the audio signal Xi increases.

As shown in FIG. 8, the first corrector 66 of FIG. 7 generates a rhythmic feature amount RBi, which is a matrix of M rows and N columns including feature values rBi[1, 1] to rBi[M, N], by applying the correction value sequence ATi generated by the first correction value calculator 62 to the rhythmic feature amount RAi generated by the feature calculator 38. Specifically, the feature values rBi[m, n] of the nth column of the rhythmic feature amount RBi is set to values obtained by multiplying the feature values rAi[m, n] of the nth column of the rhythmic feature amount RAi by the correction value aTi[n] of the correction value sequence ATi (rBi[m, n]=rAi[m, n]×aTi[n]). Accordingly, the feature values rBi[m, n] of the rhythmic feature amount RBi are more emphasized than the feature values rAi[m, n] of the rhythmic feature amount RAi as the strength of the audio signal Xi in the analysis period σT[n] increases. That is, the first corrector 66 functions as an element for correcting the distribution of the feature values rAi[m, 1] to rAi[m, N] in the rhythmic feature amount RAi.

As shown in FIG. 8, the second corrector 68 of FIG. 7 generates a rhythmic feature amount Ri (feature values ri[1, 1] to ri[M, N]) by applying the correction value sequence AFi generated by the second correction value calculator 64 to the rhythmic feature amount RBi corrected by the first corrector 66. Specifically, the feature values ri[m, n] of the mth row of the rhythmic feature amount Ri are set to values obtained by dividing the feature values rBi[m, n] of the rhythmic feature amount RBi by the correction value aFi[m] of the correction value sequence AFi (ri[m, n]=rBi[m, n]/aFi[m]). Accordingly, the difference (or variance) of the feature value ri[m, n] of each analysis band σF[m] in the rhythmic feature amount Ri is reduced (i.e., the feature value ri[m, n] is more equalized or flattened) than that of the feature value rBi[m, n] of the rhythmic feature amount RBi. That is, the second corrector 68 functions as an element for correcting the distribution of the feature values rBi[1, n] to rBi[M, n] in the rhythmic feature amount RBi.

The rhythmic feature amount R1 of the audio signal X1 and the rhythmic feature amount R2 of the audio signal X2 that the signal analyzer 22 (or the feature amount extractor 36) generates through the above procedure are stored in the storage device 14. The display controller 24 displays a rhythm image Gi (see FIG. 4) corresponding to each rhythmic feature amount Ri on the display device 16, similar to the first embodiment. The feature comparator 26 calculates the similarity index value Q by comparing the rhythmic feature amount R1 of the audio signal X1 and the rhythmic feature amount R2 of the audio signal X2.

Figure 9:
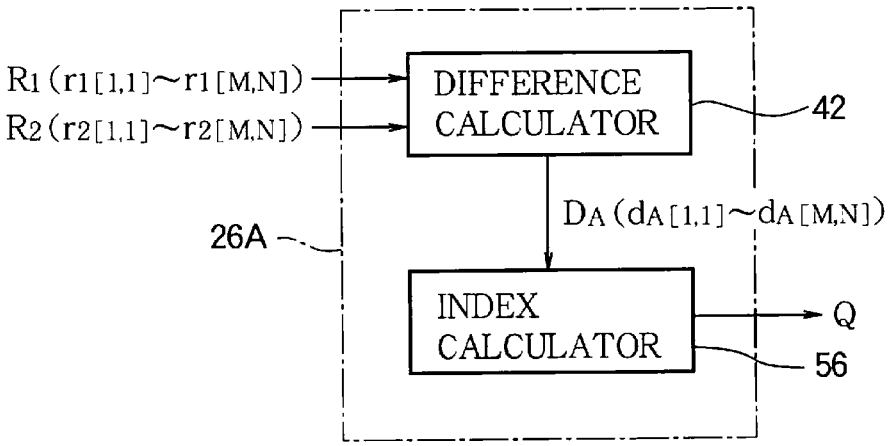
FIG. 9 is a block diagram of a feature comparator.

FIG. 9 is a block diagram of a feature comparator 26A of the second embodiment. As shown in FIG. 9, the feature comparator 26A includes a difference calculator 42 and an index calculator 56. That is, the feature comparator 26A of the second embodiment includes the elements of the feature comparator 26 (see FIG. 5) of the first embodiment, excluding the first correction value calculator 44, the second correction value calculator 46, the first corrector 52, and the second corrector 54.

The difference calculator 42 of FIG. 9 generates a difference value sequence DA corresponding to the difference between the rhythmic feature amount R1 and the rhythmic feature amount R2, which is a matrix of M rows and N columns including element values dA[1, 1] to dA[M, N]. The difference value sequence DA is generated using the same method as in the first embodiment. The index calculator 56 calculates a similarity index value Q from the difference value sequence DA generated by the difference calculator 42. Specifically, the index calculator 56 calculates a similarity index value Q by summing or averaging the respective averages (sums) of the N element values dA[m, 1] to dA[m, N] of each analysis band σF[m] in the difference value sequence DA over the M analysis bands σF[1] to σF[M]. Accordingly, similar to the first embodiment, the similarity index value Q decreases as the similarity between the rhythmic feature amount R1 of the audio signal X1 and the rhythmic feature amount R2 of the audio signal X2 increases. The second embodiment achieves the same advantages as those of the first embodiment.

In the second embodiment of the invention, the feature amount extraction part includes a first correction value calculation part that calculates a first correction value (for example, a first correction value aTi[n] of FIG. 8) of each analysis period based on a plurality of feature values (for example, feature values rAi[1, n] to rAi[M, n] of FIG. 8) corresponding to different analysis bands among feature values calculated by the feature calculation part, a second correction value calculation part that calculates a second correction value (for example, a second correction value aFi[m] of FIG. 8) of each analysis band based on a plurality of feature values (for example, feature values rAi[m, n] to rAi[m, N] of FIG. 8) corresponding to different analysis periods among feature values calculated by the feature calculation part, a first correction part that applies the first correction value of each analysis period to each feature value of the analysis period, and a second correction part that applies the second correction value of each analysis band to each feature value of the analysis band.

In addition, the second embodiment may be divided into a configuration (no matter whether the second correction value calculation part or the second correction part is present or absent) in which the feature extraction part includes the first correction value calculation part and the first correction part and another configuration (no matter whether the first correction value calculation part or the first correction part is present or absent) in which the feature extraction part includes the second correction value calculation part and the second correction part.

<C: Modifications>

Various modifications can be made to each of the above embodiments. The following are specific examples of such modifications. Two or more modifications selected from the following examples may be combined as appropriate.

(1) Modification 1

The method of calculating the feature value ri[m, n] (the feature value rAi[m, n] in the second embodiment) through the feature calculator 38 is not limited to the above example in which the average (arithmetic average) of the plurality of component values c in the analysis unit U[m, n] is calculated as the feature value ri[m, n]. For example, it is also possible to employ a configuration in which the weighted sum of the component values c using a weight set for each component value c such that the weight increases as a unit period FR having the component value c becomes closer to a beat point B on the time axis is calculated as the feature value ri[m, n]. This configuration has an advantage in that it is possible to generate a rhythmic feature amount Ri that emphasizes the influence of musical sounds near points of beats B. As can be understood from each of the above examples, the feature calculator 38 may be an element for calculating feature values ri[m, n] corresponding to a plurality of component values c in the analysis unit U[m, n].

(2) Modification 2

The correction method using the correction value sequence ATi is not limited to the above example. For example, in the first embodiment, it is possible to employ a configuration in which the first correction value aTi[n] (aTi[n]+aTi[n]) of the correction value sequence ATi is added to the element values dA[m, n] of the difference value sequence DA. Similar to the second embodiment, it is possible to employ a configuration in which the first correction value aTi[n] of the correction value sequence ATi is added to the feature values rAi[m, n] of the rhythmic feature amount RAi. The correction method using the correction value sequence AFi is also not limited to the above example. For example, in the first embodiment, it is possible to employ a configuration in which the second correction value aFi[m] (aFi[m]+aF2[m]) of the correction value sequence AFi is subtracted from the element values dB[m, n] of the difference value sequence DB. In addition, in the second embodiment, it is possible to employ a configuration in which the second correction value aFi[m] of the correction value sequence AFi is subtracted from the feature values rBi[m, n] of the rhythmic feature amount RBi.

Further, although the element value dB[m, n] is divided by the second correction value aFi[m] in order to reduce the difference (or variance) of the element value dB[m, n] of each analysis band σF[m] in the first embodiment, it is also possible to employ a configuration in which the difference (or variance) of the element value dB[m, n] of each analysis band σF[m] is emphasized by multiplying the element value dB[m, n] by the second correction value aFi[m] or by adding the second correction value aFi[m] to the element value dB[m, n]. Similarly, in the second embodiment, it is possible to employ, for example, a configuration in which the difference of the feature value rB[m, n] of each analysis band σF[m] is emphasized by multiplying the feature value rBi[m, n] by the second correction value aFi[m] or by adding the second correction value aFi[m] to the feature value rBi[m, n].

(3) Modification 3

In the first embodiment, it is possible to reverse the order of correction by the first corrector 52 (multiplication by the correction value sequence ATi) and correction by the second corrector 54 (division by the correction value sequence AFi). It is possible to omit one or both of correction using the correction value sequence ATi (through the first correction value calculator 44 and the first corrector 52) and correction using the correction value sequence AFi (through the second correction value calculator 46 and the second corrector 54). Similarly, in the second embodiment, it is possible to employ a configuration in which the first corrector 66 and the second corrector 68 are interchanged in position or a configuration in which one or both of correction using the correction value sequence ATi and correction using the correction value sequence AFi is omitted.

(4) Modification 4

Although the spectrum acquirer 32 generates the spectrum PX from the audio signal Xi in each of the above embodiments, any method may be used to acquire the spectrum PX of each unit period FR. For example, the spectrum acquirer 32 acquires each spectrum PX from the storage device 14 in the case of a configuration in which the spectrum PX of each unit period FR of the audio signal Xi is stored in the storage device 14 (such that storage of the audio signal Xi may be omitted). In addition, beats B of the audio signal Xi may be specified from the spectrum PX of each unit period FR in the case of a configuration in which the audio signal Xi is not stored in the storage device 14.

(5) Modification 5

Although the musical analysis apparatus 100 including both the signal analyzer 22 and the feature comparator 26 is illustrated in each of the above embodiments, the invention may also be realized as a music analysis apparatus including only both the signal analyzer 22 and the feature comparator 26. That is, a musical analysis apparatus (hereinafter referred to as an "analysis apparatus") used to analyze the rhythm of the audio signal Xi (or used to generate the rhythmic feature amount Ri) has a configuration in which the signal analyzer 22 of each of the above embodiments is provided and the feature comparator 26 is omitted. On the other hand, a musical analysis apparatus (hereinafter referred to as a "comparison apparatus") used to compare the rhythms of the audio signal X1 and the audio signal X2 (or used to calculate the similarity index value Q) has a configuration in which the feature comparator 26 of each of the above embodiments is provided and the signal analyzer 22 is omitted. A rhythmic feature amount Ri generated by the signal analyzer 22 of the analysis apparatus is provided to the comparison apparatus through, for example, a communication network or a portable recording medium and is then stored in the storage device 14. The feature comparator 26 of the comparison apparatus calculates the similarity index value Q by comparing each rhythmic feature amount Ri stored in the storage device 14.

What is claimed is:

1. A musical analysis apparatus comprising:

a spectrum acquisition part that acquires a spectrum for each unit period of an audio signal representing a piece of music;

a beat specification part that specifies a sequence of beats of the audio signal along a time axis; and a feature amount extraction part that divides an interval between the beats into a plurality of analysis periods along the time axis of the audio signal such that one analysis period contains a plurality of the unit periods, and that separates the spectrum of the unit periods contained in one analysis period into a plurality of analysis bands on a frequency axis of the audio signal so as to set a plurality of analysis units in one analysis period in correspondence with the plurality of the analysis bands, such that one analysis unit contains components of the spectrum belonging to the corresponding analysis band, wherein the feature amount extraction part includes a feature calculation part for calculating a feature value of each analysis unit based on the components of the spectrum contained in each analysis unit, thereby generating a rhythmic feature amount that is an array of the feature values calculated for the analysis units arranged in the time axis and in the frequency axis and that features a rhythm of the piece of music.

2. The musical analysis apparatus according to claim 1, wherein the feature amount extraction part generates a first rhythmic feature amount that features a rhythm of a first audio signal, and generates a second rhythmic feature amount that features a rhythm of a second audio signal, and wherein the musical analysis apparatus further comprises a feature comparison part that calculates a similarity index value indicating similarity between the rhythm of the first audio signal and the rhythm of the second audio signal by comparing the first rhythmic feature amount and the second rhythmic feature amount with each other.

3. The musical analysis apparatus according to claim 2, wherein the feature comparison part comprises:

a difference calculation part that calculates, for each of the analysis units, an element value corresponding to a difference between each feature value of the first rhythmic feature amount and each feature value of the second rhythmic feature amount;

a correction value calculation part that calculates a first correction value of each analysis period based on a plurality of feature values which are obtained in same analysis period of the first audio signal and which correspond to different analysis bands of the same analysis period among feature values of the rhythmic feature amount of the first audio signal, and that calculates a second correction value of each analysis period based on a plurality of feature values which are obtained in same analysis period of the second audio signal and which correspond to different analysis bands of the same analysis period among feature values of the rhythmic feature amount of the second audio signal;

a correction part that applies the first correction value of each analysis period generated for the first audio signal and the second correction value of each analysis period generated for the second audio signal to the element value of each analysis period; and an index calculation part that calculates the similarity index value from the element values after being processed by the correction part.

4. The musical analysis apparatus according to claim 2, wherein the feature comparison part comprises:

a difference calculation part that calculates, for each of the analysis units, an element value corresponding to a difference between each feature value of the first rhythmic feature amount and each feature value of the second rhythmic feature amount;

a correction value calculation part that calculates a first correction value of each analysis band of the first audio signal based on a plurality of feature values which belong to same analysis band and which correspond to different analysis periods of the same analysis band among feature values of the rhythmic feature amount of the first audio signal, and that calculates a second correction value of each analysis band of the second audio signal based on a plurality of feature values which belong to same analysis band and which correspond to different analysis periods of the same analysis band among feature values of the rhythmic feature amount of the second audio signal;

a correction part that applies the first correction value of each analysis band generated for the first audio signal and the second correction value of each analysis band generated for the second audio signal to the element value of each analysis band; and an index calculation part that calculates the similarity index value from the element values after being processed by the correction part.

5. The musical analysis apparatus according to claim 1, wherein the feature amount extraction part comprises:

a correction value calculation part that calculates a correction value of each analysis period based on a plurality of feature values which are obtained for same analysis period and which correspond to different analysis bands of the same analysis period among feature values calculated by the feature calculation part; and a correction part that applies the correction value of each analysis period to each feature value of the corresponding analysis period for correcting each feature value.

6. The musical analysis apparatus according to claim 1, wherein the feature amount extraction part comprises:

a correction value calculation part that calculates a correction value of each analysis band based on a plurality of feature values which are obtained for same analysis band and which correspond to different analysis periods of the same analysis band among feature values calculated by the feature calculation part; and a correction part that applies the correction value of each analysis band to each feature value of the corresponding analysis band for correcting each feature value.

7. A musical analysis apparatus comprising:

a storage part that stores a rhythmic feature amount for each of a first audio signal representing a piece of music and a second audio signal representing another piece of music, the rhythmic feature amount comprising an array of feature values of analysis units arranged two-dimensionally on a time axis and a frequency axis, each of the analysis units being defined at each of a plurality of analysis periods in the time axis and at each of a plurality of analysis bands in the frequency axis, the plurality of analysis periods being set by dividing an interval between beats of the piece of music such that one analysis period contains spectrum of a plurality of unit periods of the audio signal, the spectrum of one analysis period being separated into a plurality of analysis bands such that one analysis unit defined at one analysis period and at one analysis band contains components of the spectrum, the feature value of one analysis unit representing the components of the spectrum contained in the one analysis unit; and a feature comparison part that calculates a similarity index value indicating similarity between rhythms of the first audio signal and the second audio signal by comparing the respective rhythmic feature amounts of the first audio signal and the second audio signal.

8. A machine readable storage medium containing a musical analysis program being executable by a computer to perform processes of:

acquiring a spectrum for each unit period of an audio signal representing a piece of music;

specifying a sequence of beats of the audio signal along a time axis;

dividing an interval between the beats into a plurality of analysis periods along the time axis of the audio signal such that one analysis period contains a plurality of the unit periods;

separating the spectrum of the unit periods contained in one analysis period into a plurality of analysis bands on a frequency axis of the audio signal so as to set a plurality of analysis units in one analysis period in correspondence with the plurality of the analysis bands, such that one analysis unit contains components of the spectrum belonging to the corresponding analysis band;

calculating a feature value of each analysis unit based on the components of the spectrum contained in each analysis unit; and generating a rhythmic feature amount that is an array of the feature values calculated for the analysis units arranged two-dimensionally in the time axis and the frequency axis and that features a rhythm of the audio signal.

* * * * *